US011662096B2

(12) United States Patent
Salazar Lois et al.

(10) Patent No.: US 11,662,096 B2
(45) Date of Patent: May 30, 2023

(54) COMBUSTOR SWIRLER TO PSEUDO-DOME ATTACHMENT AND INTERFACE WITH A CMC DOME

(71) Applicant: General Electric Company, Schenectady, NY (US)

(72) Inventors: Gerardo Antonio Salazar Lois, West Chester, OH (US); Daniel D. Brown, Cincinnati, OH (US); Daniel J. Kirtley, Blue Ash, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/496,126

(22) Filed: Oct. 7, 2021

(65) Prior Publication Data

US 2023/0112117 A1 Apr. 13, 2023

(51) Int. Cl.
*F23R 3/00* (2006.01)
*F23R 3/38* (2006.01)

(52) U.S. Cl.
CPC ..... *F23R 3/38* (2013.01); *F23R 3/002* (2013.01); *F23R 3/007* (2013.01)

(58) Field of Classification Search
CPC .... F23R 3/002; F23R 3/12; F23R 3/14; F23R 3/007; F23R 3/286; F23R 3/38; F23R 3/60; F23R 2900/00017
See application file for complete search history.

(56) References Cited

U.S. PATENT DOCUMENTS

| | | | | |
|---|---|---|---|---|
| 5,220,786 | A | 6/1993 | Campbell | |
| 5,321,951 | A * | 6/1994 | Falls | F23R 3/34 60/740 |
| 5,970,716 | A * | 10/1999 | Forrester | F23R 3/50 60/800 |
| 8,783,038 | B2 | 7/2014 | Horikawa et al. | |
| 9,976,746 | B2 * | 5/2018 | Bloom | F23R 3/002 |
| 10,473,332 | B2 | 11/2019 | Hannwacker et al. | |
| 10,663,167 | B2 | 5/2020 | Dziech | |
| 10,801,729 | B2 | 10/2020 | Bloom | |
| 2002/0162333 | A1 | 11/2002 | Zelina | |
| 2019/0249556 | A1 | 8/2019 | Reynolds et al. | |
| 2020/0333007 | A1 | 10/2020 | Reynolds et al. | |
| 2021/0140639 | A1 * | 5/2021 | Bunel | F23R 3/002 |

FOREIGN PATENT DOCUMENTS

EP 3211312 B1 2/2020

* cited by examiner

*Primary Examiner* — Todd E Manahan
*Assistant Examiner* — Sean V Meiller
(74) *Attorney, Agent, or Firm* — Venable LLP; Edward A. Kmett; Michele V. Frank

(57) ABSTRACT

A combustor for a gas turbine includes a cowl structure, a pseudo-dome structure, a ceramic matrix composite (CMC) dome, and a swirler assembly. The swirler assembly is connected to the pseudo-dome structure, which is connected to the cowl structure, and the CMC dome is separately connected to the cowl structure apart from the swirler assembly. The swirler assembly includes a swirler dome interface wall that interfaces with the CMC dome on an upstream side of the CMC dome, and a swirler outlet extends through a CMC dome swirler opening through the CMC dome.

19 Claims, 6 Drawing Sheets

COMBUSTOR SWIRLER TO PSEUDO-DOME ATTACHMENT AND INTERFACE WITH A CMC DOME

TECHNICAL FIELD

The present disclosure relates to connecting a combustor swirler in a combustor so as to interface with a CMC (Ceramic Matrix Composite) dome in a gas turbine engine.

BACKGROUND

Some conventional gas turbine engines are known to include rich-burn combustors that typically use a swirler assembly that is connected with a dome structure. The swirler assembly and the dome structure are both generally metallic and are connected to one another. The metallic dome structure has been known to include a deflector wall on a combustion chamber side of the dome, where the deflector wall deflects heat generated in the combustor during combustion. Cooling holes are generally included through the dome structure so as to provide some surface cooling of the dome and deflector wall. The metallic swirler assembly is generally brazed to, or welded to, the dome structure.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The implementation of non-metallic materials in combustors is becoming more prevalent. In particular, the implementation of Ceramic Matrix Composite (CMC) materials can be used to form the dome structure, rather than utilizing the conventional metallic dome structures. The CMC materials have better thermal capabilities than the conventional metallic materials, and, as a result, less cooling is required for a CMC dome than is required for the conventional metallic dome. The less cooling needed for the dome means that more air is available for other purposes, including being used as dilution air. In addition, the CMC dome structure does not require a deflector wall, thereby reducing the overall axial length of the dome, which also reduces the length of the combustor module. The implementation of the CMC dome with a metallic swirler, however, presents a challenge as to the ability to connect the metallic swirler to the CMC dome, and to provide for a thermal decoupling between the metallic swirler and the CMC dome. The present disclosure provides a technique to separately mount the metallic swirler to a cowl using a metallic pseudo-dome structure, and to also separately mount the CMC dome to the cowl. The swirler assembly, being connected to the pseudo-dome structure apart from the CMC dome, can nonetheless interface with the CMC dome.

Figure 1:
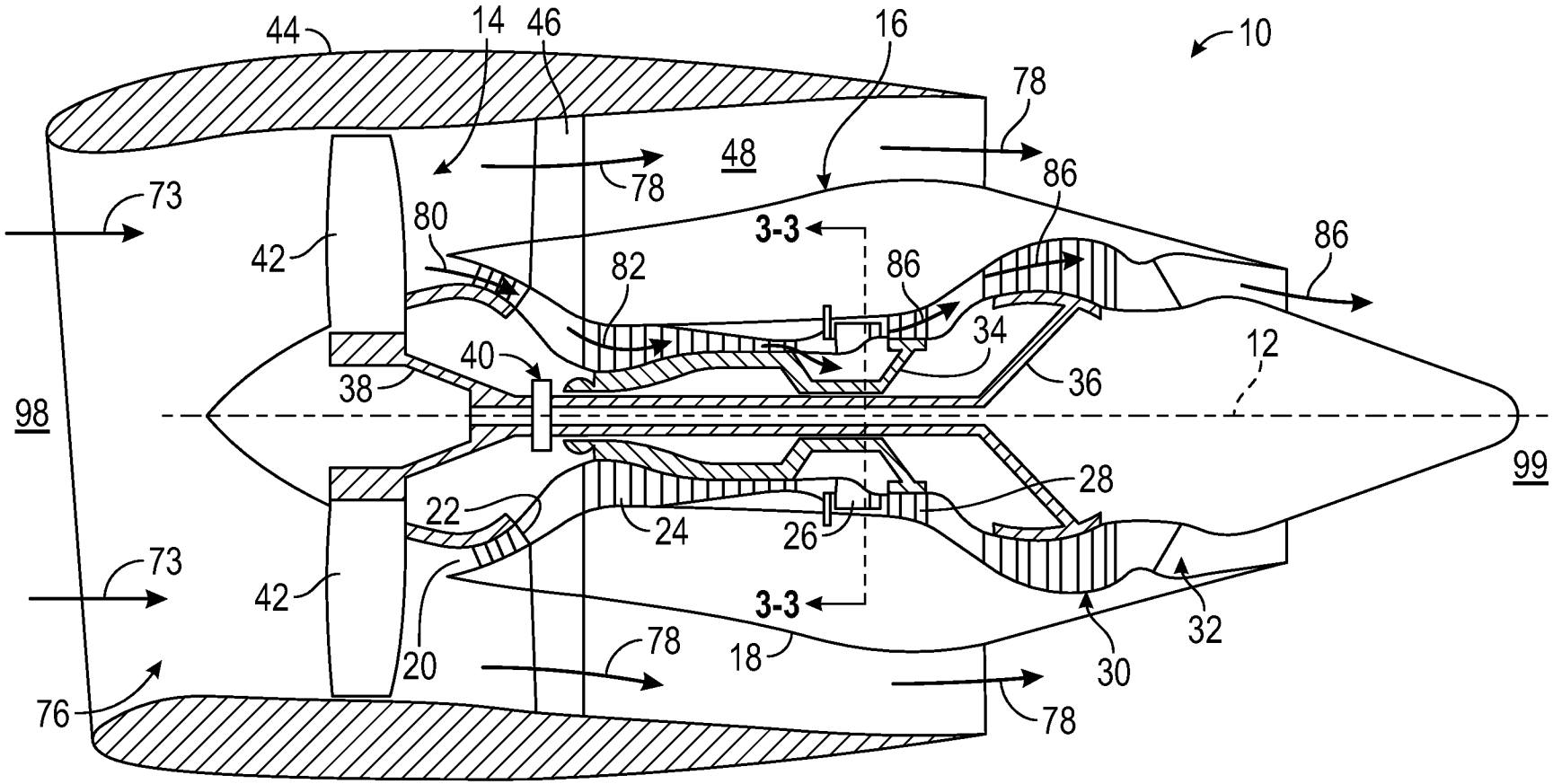
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a ducted turbofan engine, the present disclosure is also applicable to turbomachinery in general, including turbojet, turboprop, and turboshaft gas turbine engines, including marine and industrial turbine engines and auxiliary power units. In addition, the present disclosure is not limited to ducted fan type turbine engines such as that shown in FIG. 1, but can be implemented in unducted fan (UDF) type turbine engines. As shown in FIG. 1, engine 10 has a centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases, or at least partially forms, in serial flow relationship, a compressor section (22/24) having a booster or low pressure (LP) compressor 22, a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to, and extend radially outwardly from, the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
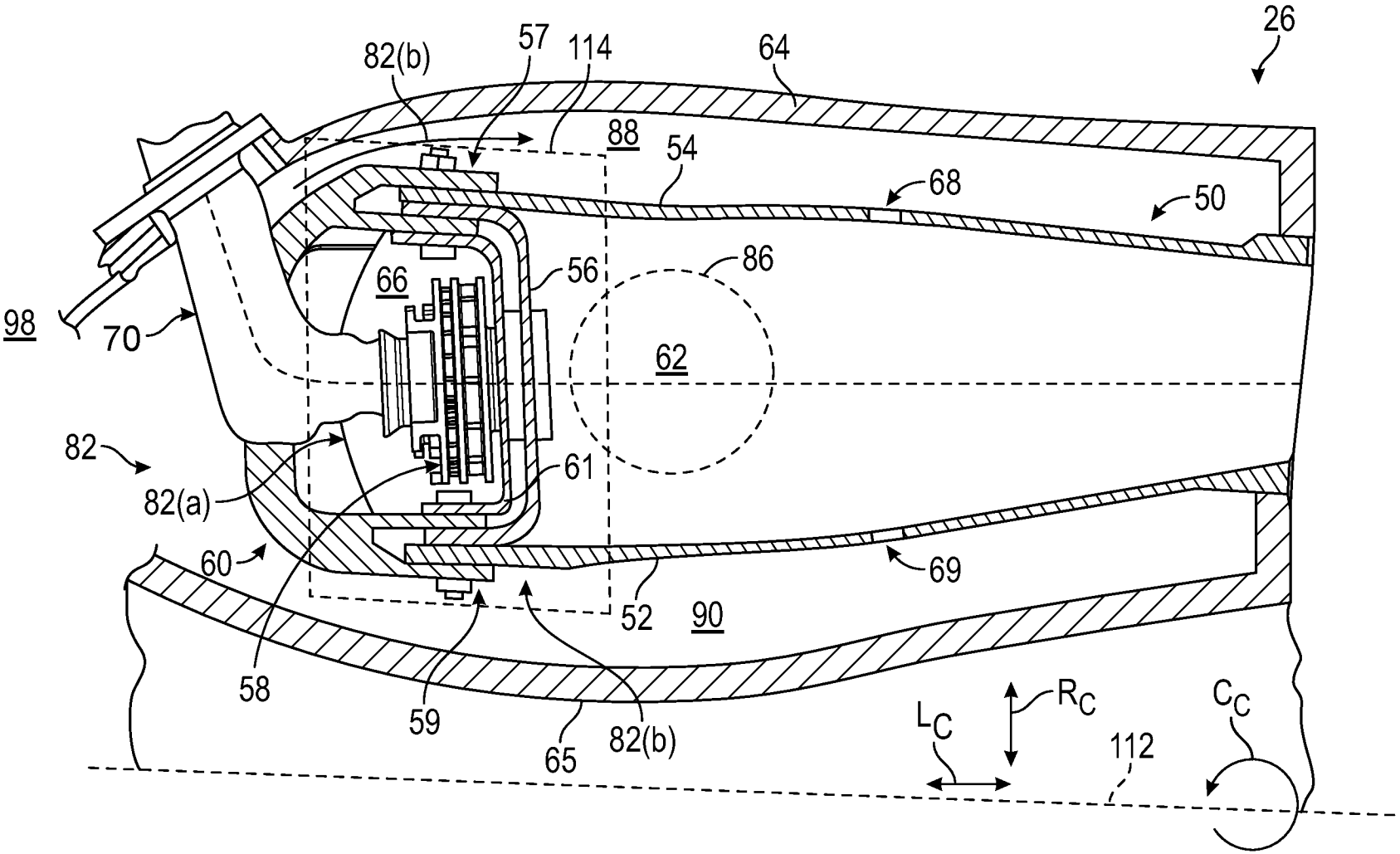
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. FIG. 2 depicts a combustor axial centerline 112 that may generally correspond to the centerline axis 12. Thus, the combustor 26 of FIG. 2 defines a combustor longitudinal direction (Lc) corresponding to the combustor axial centerline 112, a combustor radial direction (Rc) extending outward from the combustor axial centerline 112, and a combustor circumferential direction (Cc) extending circumferentially about the combustor axial centerline 112. As shown in FIG. 2, the combustor 26 may generally include a cowl structure 60, and a combustor liner 50, having an inner liner 52 and an outer liner 54, each of which are connected with the cowl structure 60. The cowl structure 60 extends in the circumferential direction with respect to the combustor axial centerline 112, and as will be described below, may be comprised of a plurality of cowl segments that, together, extend circumferentially about the combustor axial centerline 112. Each of the inner liner 52 and the outer liner 54 are annular liners that extend circumferentially about the combustor axial centerline 112. A Ceramic Matrix Composite (CMC) dome 56 extends in the combustor radial direction Rc between the inner liner 52 and the outer liner 54 and is connected with the cowl structure 60 at a cowl radially outer portion 57 and a cowl radially inner portion 59. The CMC dome 56 also extends circumferentially about the combustor axial centerline 112. Together, the inner liner 52, the outer liner 54, and the CMC dome 56 define a combustion chamber 62 therebetween.

The combustor 26 also includes a swirler assembly 58 that is mounted to a pseudo-dome structure 61. The pseudo-dome structure 61 is connected to the cowl structure 60 at the cowl radially outer portion 57 and the cowl radially inner portion 59. The pseudo-dome structure 61 may extend circumferentially about the combustor axial centerline 112, or, as will be described below, may include multiple segments that extend about the circumference of the combustor 26. The swirler assembly 58 is mounted to the pseudo-dome structure 61 and extends through the CMC dome 56. The swirler assembly 58 is connected with a fuel nozzle assembly 70, which injects fuel into the swirler assembly 58. In the combustion chamber 62, an initial chemical reaction of an ignited fuel-oxidizer mixture injected into the combustion chamber 62 by the swirler assembly 58 occurs to generate combustion gases 86. The combustion gases 86 then flow further downstream into the HP turbine 28 and the LP turbine 30. While FIG. 2 depicts a single swirler assembly 58, as will be described below, it can be appreciated that a plurality of the swirler assemblies 58 are present in the combustor 26, where the respective swirler assemblies 58 are circumferentially spaced apart from one another about the combustor axial centerline 112.

The combustor 26 further includes an outer casing 64 that extends circumferentially about the combustor axial centerline 112, and an inner casing 65 that also extends circumferentially about the combustor axial centerline 112. An outer flow passage 88 is defined between the outer casing 64 and the outer liner 54, and an inner flow passage 90 is defined between the inner casing 65 and the inner liner 52. The outer liner 54 may also include a plurality of outer liner dilution openings 68 that are circumferentially spaced around the outer liner 54. Similarly, the inner liner 52 may include a plurality of inner liner dilution openings 69 that are circumferentially spaced around the inner liner 52.

Referring back to FIG. 1, in operation, air 73 enters the nacelle 44 at a nacelle inlet 76, and a portion of the air 73 enters the compressor section (22/24) as compressor inlet air flow 80, where it is compressed. Another portion of the air 73 enters the bypass airflow passage 48, thereby providing a bypass airflow 78. In FIG. 2, compressed air 82 from the compressor section (22/24) enters the combustor 26 via a diffuser (not shown). A portion of the compressed air 82(*a*) enters a cowl structure 60 into a pressure plenum 66, while another portion of the compressed air 82(*b*) passes to the outer flow passage 88 and to the inner flow passage 90. The compressed air 82(*a*) in the pressure plenum 66 passes through the swirler assembly 58 to mix with fuel injected by the fuel nozzle assembly 70 and is ignited to generate the combustion gases 86. A portion of the compressed air 82(*b*) in the outer flow passage 88 may be used as dilution air provided to the combustion chamber 62 through the plurality of outer liner dilution openings 68, and another portion of the compressed air 82(*b*) in the inner flow passage 90 may also be used as dilution air provided to the combustion chamber 62 through the plurality of inner liner dilution openings 69.

Figure 3:
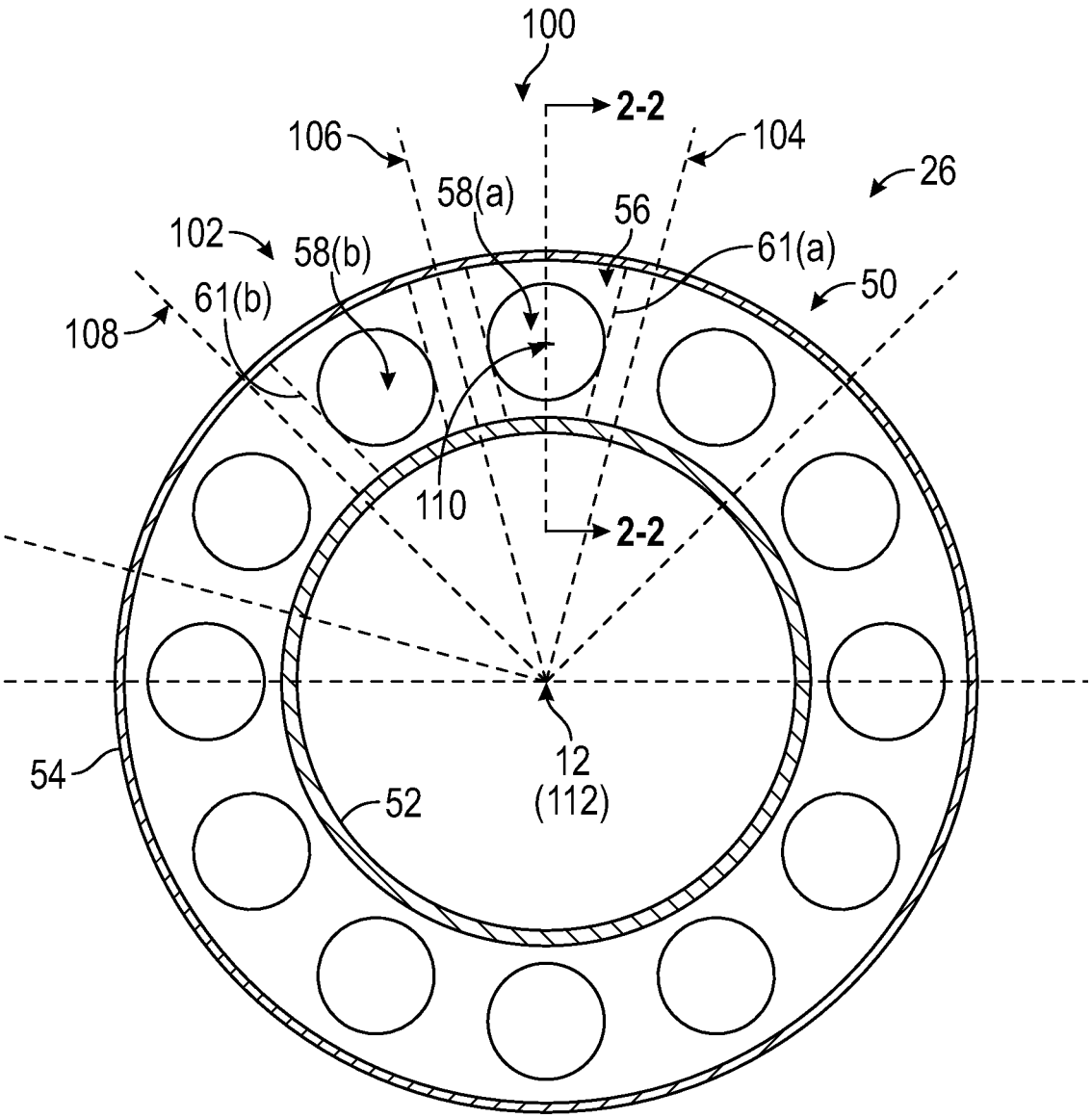
FIG. 3 is a partial cross-sectional aft forward-looking view of an exemplary combustor, taken at plane 3-3 of FIG. 1, according to an aspect of the present disclosure.

FIG. 3 is a partial cross-sectional view of a combustor 26 taken at plane 3-3 shown in FIG. 1. As seen in FIG. 3, the combustor 26 has a generally annular combustor liner 50 that extends circumferentially about the centerline axis 12 of the engine 10. As it may relate to the combustor 26, the centerline axis 12 may also correspond to the combustor axial centerline 112. The combustor liner 50 includes the outer liner 54 and the inner liner 52, each of which extends circumferentially about the combustor axial centerline 112. The CMC dome 56 also extends circumferentially about the combustor axial centerline 112. The cross-sectional view of FIG. 2 may be taken at, for example, plane 2-2 of FIG. 3, and while the cross section of FIG. 2 depicts a single swirler assembly 58, a plurality of representative swirler assemblies 58(*a*), 58(*b*), etc., are shown in FIG. 3 as being circumferentially spaced about the combustor axial centerline 112. With respect to each swirler assembly 58(*a*), 58(*b*), a portion of the combustor 26 may be considered to be a segment of the combustor 26. That is, the combustor 26, although it may extend circumferentially about the combustor axial centerline 112, may be considered to include multiple segments corresponding to each swirler assembly 58. For example, a first segment 100 corresponding to the swirler assembly 58(*a*) and extending in the circumferential direction between a segment boundary end 104 and a segment boundary end 106 may be included among the segments. A second segment 102 corresponding to swirler assembly 58(*b*) and extending in the circumferential direction between the segment boundary end 106 and a segment boundary end 108 may be included among the plurality of segments. As can be readily understood, additional segments (not labeled) and swirler assemblies (not labeled) are provided about the entire circumference of the combustor 26. As mentioned above, the pseudo-dome structure 61 may be implemented as multiple segments. In this case, rather than the pseudo-dome structure 61 extending circumferentially about the combustor axial centerline 112, a first segment pseudo-dome structure 61(*a*) may be implemented in the first segment 100, a second pseudo-dome structure 61(*b*) may be implemented in the second segment 102, etc. Thus, each pseudo-dome segment (61(*a*), 61(*b*)) may be included to mount the respective segment swirler assembly (58(*a*), 58(*b*)).

Figure 4:
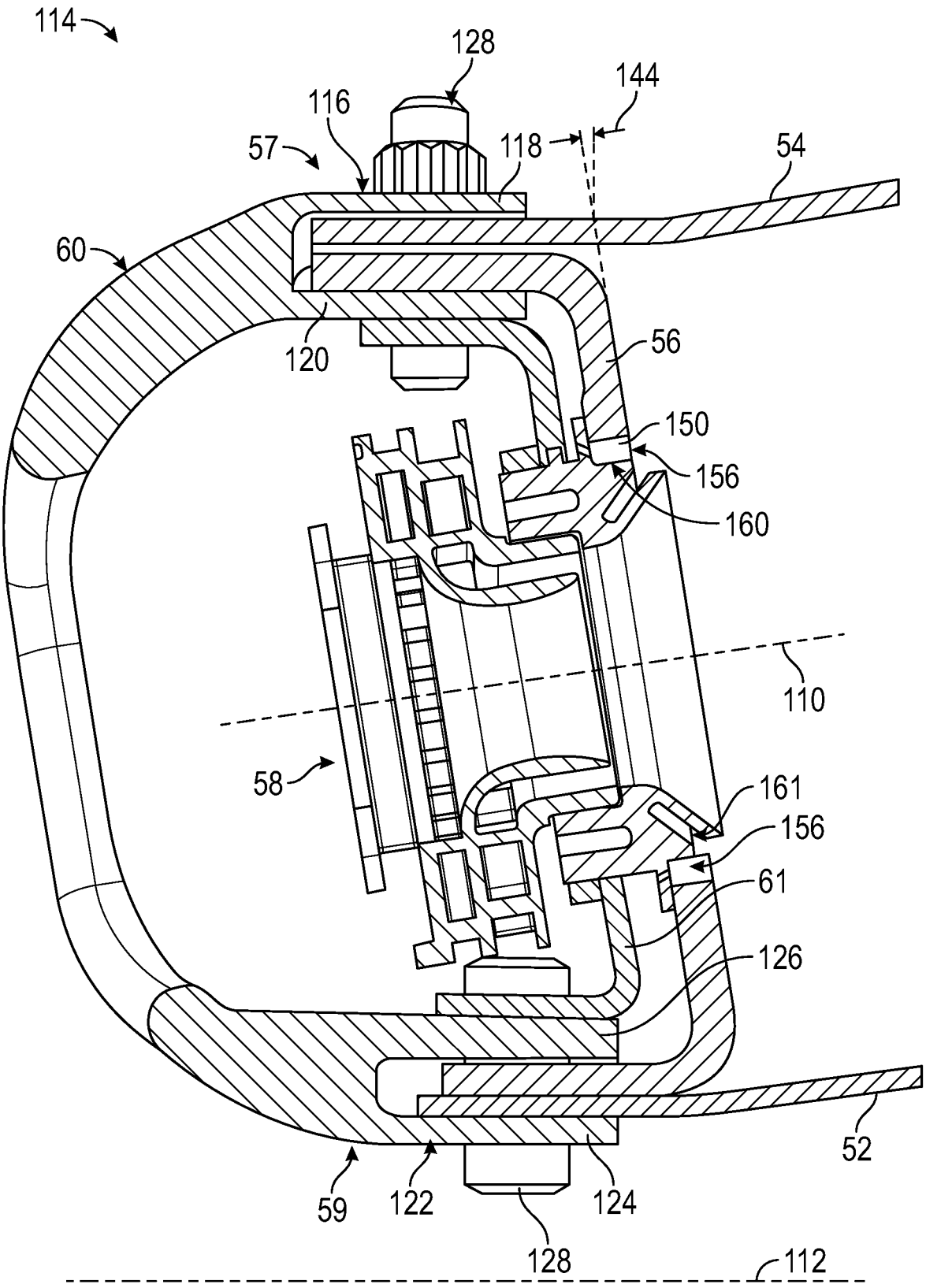
FIG. 4 is a partial cross-sectional side view swirler to pseudo-dome connection, and a CMC dome interface, taken at detail view 114 of FIG. 2, according to an aspect of the present disclosure.

FIG. 4 depicts a partial cross-sectional view of a swirler and dome connection taken at detail view 114 of FIG. 2. In FIG. 4, the fuel nozzle assembly 70 has been removed. As seen in FIG. 4, the cowl structure 60 includes the cowl radially outer portion 57 and the cowl radially inner portion 59. The cowl radially outer portion 57 may comprise a cowl outer clevis 116 having a first outer clevis portion 118 on a radially outer side of the cowl outer clevis 116, and a second outer clevis portion 120 on a radially inner side of the cowl outer clevis 116. Similarly, the cowl radially inner portion 59 may comprise a cowl inner clevis 122 having a first inner clevis portion 124 on a radially inner side of the cowl inner clevis 122, and a second inner clevis portion 126 on a radially outer side of the cowl inner clevis 122. The pseudo-dome structure 61 is connected to the cowl structure 60 at the cowl radially outer portion 57 and the cowl radially inner portion 59. This connection will be described in more detail below. The CMC dome 56 and the outer liner 54 are connected to the cowl structure 60 within the cowl outer clevis 116 via mechanical connecting members 128, such a bolted joint. Similarly, the inner liner 52 and the CMC dome 56 are connected to the cowl structure 60 within the cowl inner clevis 122 via connecting members 128. The swirler assembly 58 is connected to the pseudo-dome structure 61 and extends through the CMC dome 56. This connection will also be described in more detail below.

Figure 5:
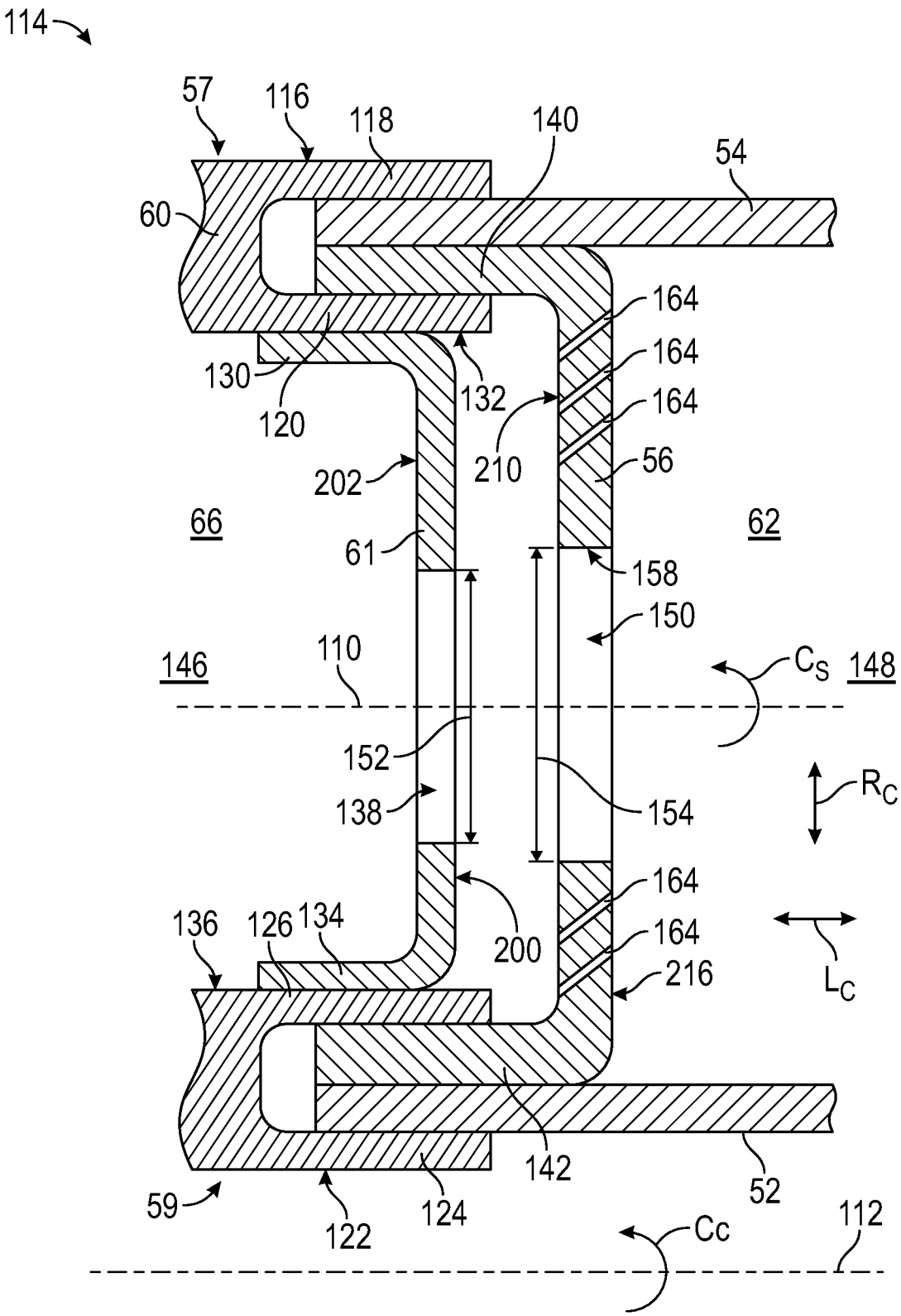
FIG. 5 is a partial cross-sectional side view of a CMC dome and pseudo-dome structure connection to a cowl, taken at detail view 114 of FIG. 2, according to an aspect of the present disclosure.

FIG. 5 depicts a cross-sectional view of the CMC dome 56 and pseudo-dome structure 61 connection with the cowl structure 60, taken at detail view 114 of FIG. 2, according to an aspect of the present disclosure. In FIG. 5, the connecting members 128 are not shown, and the swirler 58 has been removed, but the swirler centerline axis 110 is depicted therein for reference purposes, and an upstream direction 146 and a downstream direction 148 are defined with respect to the swirler centerline axis 110. The pseudo-dome structure 61 is connected to the cowl outer clevis 116. More specifically, a radially outer end 130 of the pseudo-dome structure 61 may extend in the upstream direction 146 and is connected (e.g., via brazing or a bolted joint) to a radially inner surface 132 of the outer clevis second portion 120. The pseudo-dome structure 61 is also connected to the cowl inner clevis 122, where a radially inner end 134 of the pseudo-dome structure 61 may extend in the upstream direction 146 and is connected (e.g., via brazing or a bolted joint) to a radially outer surface 136 of the inner clevis second portion 126. The pseudo-dome structure 61 also includes a pseudo-dome swirler opening 138 therethrough for mounting the swirler assembly 58, as will be described below. The pseudo-dome swirler opening 138 may be a cylindrical opening that, as will be described below, has a pseudo-dome swirler opening diameter 152 that is sized to match an annular outer axial wall diameter 162 (FIG. 6) of the swirler assembly 58 for mounting the swirler assembly 58 to the pseudo-dome structure 61. Thus, the swirler centerline axis 110 (FIG. 4) may also be considered to correspond to a centerline through the pseudo-dome swirler opening 138.

The CMC dome 56, as was mentioned above, extends circumferentially about the combustor axial centerline 112 and also extends in the combustor radial direction (Rc). It is noted that, while FIG. 5 may appear to depict the CMC dome 56 as extending parallel with the combustor radial direction Rc, as shown in FIG. 4, the CMC dome 56, and correspondingly, the pseudo-dome structure 61, may be arranged at a dome angle 144 with respect to the combustor radial direction Rc. When the CMC dome 56 is arranged at the dome angle 144, the CMC dome 56, and the pseudo-dome structure 61, are nonetheless considered to extend in the combustor radial direction Rc. A radially outer end 140 of the CMC dome 56 may extend in the upstream direction 146 and extend into the cowl outer clevis 116, and a radially inner end 142 of the CMC dome 56 may extend in the upstream direction 146 and extend into the cowl inner clevis 122. The outer liner 54 also extends into the cowl outer clevis 116 and, as was shown in FIG. 4, the radially outer end 140 of the CMC dome 56 and the outer liner 54 are suitably connected to the cowl outer clevis 116 via connecting members 128. As was also shown in FIG. 4, the CMC dome 56 and the outer liner 54 are connected to the cowl outer clevis 116 via connecting members 128, and the CMC dome 56 and the inner liner 52 are connected to the cowl inner clevis 122 via the connecting members 128.

The CMC dome 56 includes a CMC dome swirler opening 150 through the CMC dome 56. The CMC dome swirler opening 150 may be a cylindrical opening having a CMC dome swirler opening diameter 154 that, as will be described below, may be greater than a diameter 160 of a swirler outlet end 161 (FIG. 4) of the swirler assembly 58 so as to provide a circumferential gap 156 (FIG. 4) between an inner surface 158 of the CMC dome swirler opening 150 and the swirler outlet end 161 of the swirler assembly 58. The CMC dome swirler opening 150 is arranged such that it is generally centered about the swirler centerline axis 110, and is generally axially aligned with the pseudo-dome swirler opening 138. Of course, with the CMC dome swirler opening diameter 154 being greater than the diameter 160 of the swirler outlet end 161 of the swirler assembly 58 so as to form the circumferential gap 156, the CMC dome swirler opening 150 and the pseudo-dome swirler opening 138 may be somewhat axially offset from one another with respect to the swirler centerline axis 110. The CMC dome 56 may optionally include a plurality of dome cooling passages 164 through the CMC dome 56.

Figure 6:
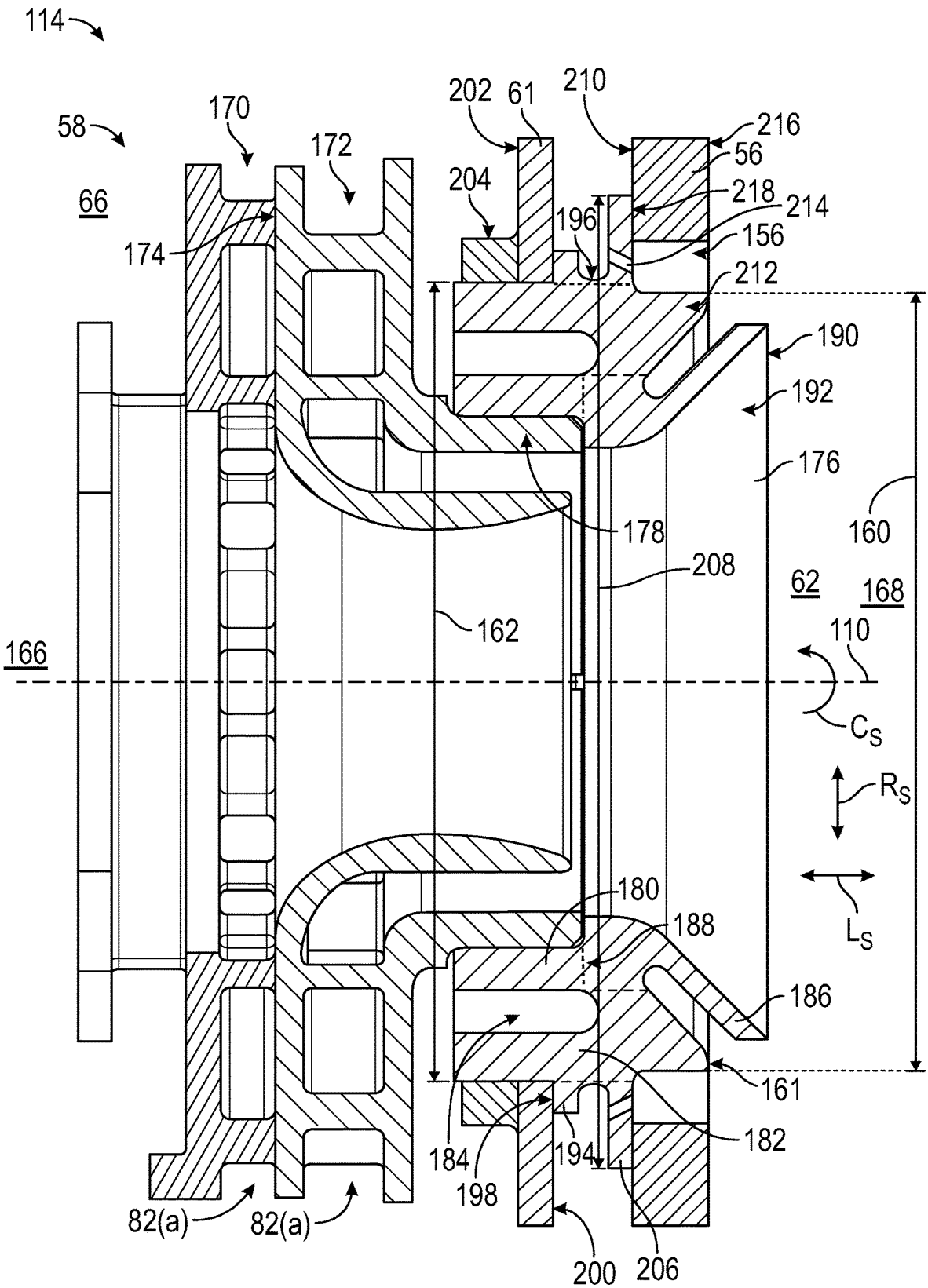
FIG. 6 is an enlarged partial cross-sectional side view swirler to pseudo-dome connection, and a CMC dome interface, taken at detail view 114 of FIG. 2, according to an aspect of the present disclosure.

FIG. 6 depicts an example of a swirler assembly 58 with the CMC dome 56 and the pseudo-dome structure 61 connected thereto, according to an aspect of the present disclosure. In FIG. 6, the swirler assembly 58 can be seen to define the swirler centerline axis 110 that extends in a swirler longitudinal direction (Ls), and defines a swirler upstream direction 166 and a swirler downstream direction 168. A swirler radial direction (Rs) extends outward from the swirler centerline axis 110, and a swirler assembly circumferential direction (Cs) extends circumferentially about the swirler centerline axis 110. The swirler assembly 58 is generally formed of metallic materials, as compared with the ceramic matrix composite material of the CMC dome 56. That is, various component parts of the swirler assembly 58 are constructed of metal alloy materials that are more conducive to structural expansion due to increased temperatures within the combustor than is the CMC material of the CMC dome 56.

The swirler assembly 58 includes a primary swirler 170 and a secondary swirler 172 connected to a downstream side 174 of the primary swirler 170. The primary swirler 170 induces a radially inward swirl to compressed air 82(*a*) from the pressure plenum 66 (FIG. 2) passing through the primary swirler 170. The secondary swirler 172 induces a radially inward swirl to the compressed air 82(*a*) passing through the secondary swirler 172 from the pressure plenum 66. The swirler assembly 58 further includes a flare 176 connected to a downstream end 178 of the secondary swirler 172. The flare 176 and its connection with the pseudo-dome structure 61 and its interface with the CMC dome 56 will now be described in more detail.

The flare 176 extends circumferentially about the swirler centerline axis 110. The flare 176 is seen to include an annular inner axial wall 180 that extends circumferentially about the swirler centerline axis 110, and also extends in the swirler longitudinal direction Ls. The annular inner axial wall 180 is connected to the downstream end 178 of the secondary swirler, such as by being brazed. The flare 176 also includes an annular outer axial wall 182 that extends circumferentially about the swirler centerline axis 110, and also extends in the flare longitudinal direction Ls. The annular outer axial wall 182 is radially outward of the annular inner axial wall 180, and a cavity 184 may be formed therebetween. The flare 176 further includes an annular conical wall 186 that extends circumferentially about the swirler centerline axis 110, and also extends radially outward and downstream from a downstream end 188 of the annular inner axial wall 180. A swirler downstream end 190 of the annular conical wall 186 comprises a swirler outlet 192.

The annular outer axial wall 182 includes a swirler mounting wall 194 extending radially outward from an annular outer axial wall outer surface 196 of the annular outer axial wall 182. The swirler mounting wall 194 may also extend circumferentially about the swirler centerline axis 110, although the swirler mounting wall 194 need not extend about the entire circumference and may instead be comprised of various mounting wall segments (not shown) about the circumference of the annular outer axial wall outer surface 196. The annular outer axial wall diameter 162 is sized so as to be slightly less than the pseudo-dome swirler opening diameter 152 of the pseudo-dome swirler opening 138 (FIG. 5) so that the flare 176 can be inserted through the pseudo-dome swirler opening 138. The flare 176 is thus inserted through the pseudo-dome swirler opening 138 so that an upstream side 198 of the swirler mounting wall 194 engages with a downstream side 200 of the pseudo-dome structure 61. A swirler mounting ring 204 may be installed on a downstream side 202 of the pseudo-dome structure 61. The swirler mounting ring 204 may extend circumferentially about the swirler centerline axis 110 and may extend radially outward from the annular outer axial wall outer surface 196. The flare 176 may be connected to the pseudo-dome structure 61 by, for example, brazing the swirler mounting ring 204, the pseudo-dome structure 61, and the swirler mounting wall 194 together with each other. Of course, other connecting mechanisms could be employed instead, such as bolted joints, to join the flare 176 to the pseudo-dome structure 61. The connection between the flare 176, the swirler mounting wall 194, and the swirler mounting ring 204 prevents the flare 176, and, consequently, the swirler assembly 58, from rotating about the swirler centerline axis 110.

The flare 176 further includes a swirler dome interface wall 206 that extends radially outward from the annular outer axial wall outer surface 196, and extends circumferentially about the swirler centerline axis 110. An outer diameter 208 of the swirler dome interface wall 206 is greater than the CMC dome swirler opening diameter 154 (FIG. 5). When the swirler assembly 58 is connected to the pseudo-dome structure 61 as described above, a downstream surface 218 of the swirler dome interface wall 206 interfaces with a CMC dome upstream surface 210 surrounding the CMC dome swirler opening 150 of the CMC dome 56. The swirler dome interface wall 206 may provide a slight axial force against the CMC dome 56, but allow the swirler assembly 58 to move radially during operation.

A downstream end 212 of the annular outer axial wall 182 extends circumferentially about the swirler centerline axis 110, and defines the swirler outlet end 161 of the swirler assembly 58. As was mentioned above, the diameter 160 of the swirler outlet end 161 is less than the CMC dome swirler opening diameter 154 of the CMC dome swirler opening 150, such that the circumferential gap 156 is defined between the inner surface 158 of the CMC dome swirler opening 150 and the annular outer axial wall outer surface 196 of the swirler outlet end 161. The swirler outlet end 161, and the swirler downstream end 190 extend through the CMC dome swirler opening 150 and may extend beyond a downstream surface 216 of the CMC dome 56 into the combustion chamber 62. The swirler dome interface wall 206 may also include a plurality of purge orifices 214 extending through the swirler dome interface wall 206 into the circumferential gap 156 so as to provide a purge flow of an oxidizer through the purge orifices 214.

While the foregoing description relates generally to a gas turbine engine, it can readily be understood that the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine, the combustor comprising: a cowl structure; a pseudo-dome structure including a pseudo-dome swirler opening therethrough, the pseudo-dome structure being connected to the cowl structure; a ceramic matrix composite (CMC) dome including a CMC dome swirler opening therethrough, and having a CMC dome upstream surface surrounding the CMC dome swirler opening, the CMC dome being connected to the cowl structure; and a swirler including a swirler dome interface wall, the swirler being connected to the pseudo-dome structure through the pseudo-dome swirler opening, and extending through the CMC dome swirler opening with the swirler dome interface wall interfacing with the CMC dome upstream surface.

The combustor according to any preceding clause, wherein the combustor defines a combustor axial centerline along a combustor longitudinal direction, a combustor radial direction extending outward from the combustor axial centerline, and a combustor circumferential direction extending circumferentially about the combustor axial centerline, the cowl structure extends in the combustor circumferential direction and the combustor longitudinal direction, and has a cowl radially outer portion and a cowl radially inner portion, the pseudo-dome structure extends in the combustor circumferential direction, and extends in the combustor radial direction and is connected to the cowl radially outer portion and the cowl radially inner portion, the CMC dome extends circumferentially about the combustor axial centerline, and extends in the combustor radial direction, the CMC dome being connected to the cowl radially outer portion and to the cowl radially inner portion, the CMC dome, and the swirler defines a swirler centerline axis therethrough that defines a swirler longitudinal direction, the swirler including (a) a swirler outlet on a downstream side of the swirler, (b) the swirler dome interface wall extending radially outward in a swirler radial direction with respect to the swirler centerline axis, the swirler dome interface wall being disposed upstream from a swirler outlet end, and (c) a swirler mounting wall extending radially outward with respect to the swirler centerline axis, the swirler mounting wall being arranged upstream of the swirler dome interface wall, and the swirler extends through the pseudo-dome swirler opening and the swirler mounting wall is connected to the pseudo-dome structure, such that a downstream surface of the swirler dome interface wall interfaces with the CMC dome upstream surface and the swirler outlet extends through the CMC dome swirler opening.

The combustor according to any preceding clause, wherein the combustor comprises a plurality of segments arranged circumferentially about the combustor axial centerline, each segment including a respective cowl structure, a respective CMC dome swirler opening through the CMC dome, a respective pseudo-dome structure, and a respective swirler mounted to the pseudo-dome structure.

The combustor according to any preceding clause, further comprising a swirler mounting ring, wherein the pseudo-dome structure is mounted to an upstream side of the swirler mounting wall, and the swirler mounting ring is connected to the swirler and to an upstream side of the pseudo-dome structure.

The combustor according to any preceding clause, wherein the swirler is connected to the pseudo-dome structure and the swirler mounting ring via brazing or welding.

The combustor according to any preceding clause, wherein the cowl radially outer portion comprises an outer clevis having a first outer clevis portion on a radially outer side of the outer clevis, and a second outer clevis portion on a radially inner side of the outer clevis, and the pseudo-dome structure is connected to a radially inner surface of the second outer clevis portion.

The combustor according to any preceding clause, wherein the pseudo-dome structure is connected to the second outer clevis portion via brazing or welding.

The combustor according to any preceding clause, wherein the CMC dome is connected to the cowl structure within the outer clevis between the first outer clevis portion and the second outer clevis portion.

The combustor according to any preceding clause, wherein the CMC dome is connected to the outer clevis via a mechanical connecting member.

The combustor according to any preceding clause, further comprising an outer liner extending circumferentially about the combustor axial centerline and extending in the combustor longitudinal direction, the outer liner being connected to the cowl structure within the outer clevis, between the first outer clevis portion and the CMC dome.

The combustor according to any preceding clause, wherein a circumferential gap is provided between an inner surface of the CMC dome swirler opening and an outer surface of the swirler outlet end.

The combustor according to any preceding clause, wherein the swirler dome interface wall includes a plurality of purge orifices therethrough, the plurality of purge orifices being arranged to provide a purge flow of an oxidizer to the circumferential gap.

The combustor according to any preceding clause, wherein the pseudo-dome structure extends circumferentially about the combustor axial centerline.

The combustor according to any preceding clause, wherein the combustor comprises a plurality of segments arranged circumferentially about the combustor axial centerline, each segment including a respective cowl structure, a respective CMC dome swirler opening through the CMC dome, a respective pseudo-dome swirler opening, and a respective swirler mounted to the pseudo-dome structure.

The combustor according to any preceding clause, wherein the cowl radially inner portion comprises an inner clevis having a first inner clevis portion on a radially inner side of the inner clevis, and a second inner clevis portion on a radially outer side of the inner clevis, and the pseudo-dome structure is connected to a radially outer surface of the second inner clevis portion.

The combustor according to any preceding clause, wherein the CMC dome is connected to the cowl structure within the inner clevis between the first inner clevis portion and the second inner clevis portion.

The combustor according to any preceding clause, further comprising an inner liner extending circumferentially about the combustor axial centerline and extending in the combustor longitudinal direction, the inner liner being connected to the cowl structure within the inner clevis, between the first inner clevis portion and the CMC dome.

The combustor according to any preceding clause, wherein the swirler comprises (a) a primary swirler, (b) a secondary swirler connected to a downstream side of the primary swirler, and (c) a flare connected to a downstream end of the secondary swirler, the flare having (i) an annular inner axial wall extending circumferentially about the swirler centerline axis and in the swirler longitudinal direction, the annular inner axial wall being connected with the secondary swirler, (ii) an annular outer axial wall extending circumferentially about the swirler centerline axis and in the swirler longitudinal direction, the annular outer axial wall being radially outward of the annular inner axial wall, and (iii) an annular conical wall extending circumferentially about the swirler centerline axis, and extending radially outward and downstream from a downstream end of the annular inner axial wall, a downstream end of the annular conical wall comprising the swirler outlet.

The combustor according to any preceding clause, wherein the swirler mounting wall extends radially outward from an outer surface of the annular outer axial wall, and extends circumferentially about the swirler centerline axis.

The combustor according to any preceding clause, wherein the swirler dome interface wall extends radially outward from the outer surface of the annular outer axial wall, and extends circumferentially about the swirler centerline axis.

Although the foregoing description is directed to some exemplary embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor for a gas turbine, the combustor comprising:

a cowl structure;

a pseudo-dome structure including a pseudo-dome swirler opening therethrough, the pseudo-dome structure being connected to the cowl structure;

a ceramic matrix composite (CMC) dome including a CMC dome swirler opening therethrough, and having a CMC dome upstream surface surrounding the CMC dome swirler opening, the CMC dome being connected to the cowl structure; and a swirler including a swirler dome interface wall, the swirler being connected to the pseudo-dome structure through the pseudo-dome swirler opening, and extending through the CMC dome swirler opening with the swirler dome interface wall interfacing with the CMC dome upstream surface, wherein the cowl structure includes a cowl radially outer portion and a cowl radially inner portion, the pseudo-dome structure is connected to the cowl radially outer portion and the cowl radially inner portion, the cowl radially outer portion comprises an outer clevis having a first outer clevis portion on a radially outer side of the outer clevis, and a second outer clevis portion on a radially inner side of the outer clevis, and the pseudo-dome structure is connected to a radially inner surface of the second outer clevis portion.

2. The combustor according to claim 1, wherein the combustor defines a combustor axial centerline along a combustor longitudinal direction, a combustor radial direction extending outward from the combustor axial centerline, and a combustor circumferential direction extending circumferentially about the combustor axial centerline, the cowl structure extends in the combustor circumferential direction and extends in the combustor longitudinal direction, the pseudo-dome structure extends in the combustor circumferential direction, and extends in the combustor radial direction, the CMC dome extends circumferentially about the combustor axial centerline, and extends in the combustor radial direction, the CMC dome being connected to the cowl radially outer portion and to the cowl radially inner portion, and the swirler defines a swirler centerline axis therethrough that defines a swirler longitudinal direction, the swirler including (a) a swirler outlet on a downstream side of the swirler, (b) the swirler dome interface wall extending radially outward in a swirler radial direction with respect to the swirler centerline axis, the swirler dome interface wall being disposed upstream from a swirler outlet end, and (c) a swirler mounting wall extending radially outward with respect to the swirler centerline axis, the swirler mounting wall being arranged upstream of the swirler dome interface wall, and the swirler extends through the pseudo-dome swirler opening and the swirler mounting wall is connected to the pseudo-dome structure, such that a downstream surface of the swirler dome interface wall interfaces with the CMC dome upstream surface and the swirler outlet extends through the CMC dome swirler opening.

3. The combustor according to claim 2, wherein the combustor comprises a plurality of segments arranged circumferentially about the combustor axial centerline, each segment including a respective cowl structure, a respective CMC dome swirler opening through the CMC dome, a respective pseudo-dome structure, and a respective swirler mounted to the pseudo-dome structure.

4. The combustor according to claim 2, further comprising a swirler mounting ring, wherein the pseudo-dome structure is mounted to an upstream side of the swirler mounting wall, and the swirler mounting ring is connected to the swirler and to an upstream side of the pseudo-dome structure.

5. The combustor according to claim 4, wherein the swirler is connected to the pseudo-dome structure and the swirler mounting ring via brazing or welding.

6. The combustor according to claim 2, wherein a circumferential gap is provided between an inner surface of the CMC dome swirler opening and an outer surface of the swirler outlet end.

7. The combustor according to claim 6, wherein the swirler dome interface wall includes a plurality of purge orifices therethrough, the plurality of purge orifices being arranged to provide a purge flow of an oxidizer to the circumferential gap.

8. The combustor according to claim 2, wherein the pseudo-dome structure extends circumferentially about the combustor axial centerline.

9. The combustor according to claim 8, wherein the combustor comprises a plurality of segments arranged circumferentially about the combustor axial centerline, each segment including a respective cowl structure, a respective CMC dome swirler opening through the CMC dome, a respective pseudo-dome swirler opening, and a respective swirler mounted to the pseudo-dome structure.

10. The combustor according to claim 2, wherein the swirler comprises (a) a primary swirler, (b) a secondary swirler connected to a downstream side of the primary swirler, and (c) a flare connected to a downstream end of the secondary swirler, the flare having (i) an annular inner axial wall extending circumferentially about the swirler centerline axis and in the swirler longitudinal direction, the annular inner axial wall being connected with the secondary swirler, (ii) an annular outer axial wall extending circumferentially about the swirler centerline axis and in the swirler longitudinal direction, the annular outer axial wall being radially outward of the annular inner axial wall, and (iii) an annular conical wall extending circumferentially about the swirler centerline axis, and extending radially outward and downstream from a downstream end of the annular inner axial wall, a downstream end of the annular conical wall comprising a swirler outlet.

11. The combustor according to claim 10, wherein the swirler mounting wall extends radially outward from an outer surface of the annular outer axial wall, and extends circumferentially about the swirler centerline axis.

12. The combustor according to claim 11, wherein the swirler dome interface wall extends radially outward from the outer surface of the annular outer axial wall, and extends circumferentially about the swirler centerline axis.

13. The combustor according to claim 1, wherein the pseudo-dome structure is connected to the second outer clevis portion via brazing or welding.

14. The combustor according to claim 1, wherein the CMC dome is connected to the cowl structure within the outer clevis between the first outer clevis portion and the second outer clevis portion.

15. The combustor according to claim 14, wherein the CMC dome is connected to the outer clevis via a mechanical connecting member.

16. The combustor according to claim 14, further comprising an outer liner extending circumferentially about the combustor axial centerline and extending in the combustor longitudinal direction, the outer liner being connected to the cowl structure within the outer clevis, between the first outer clevis portion and the CMC dome.

17. The combustor according to claim 1, wherein the cowl radially inner portion comprises an inner clevis having a first inner clevis portion on a radially inner side of the inner clevis, and a second inner clevis portion on a radially outer side of the inner clevis, and the pseudo-dome structure is connected to a radially outer surface of the second inner clevis portion.

18. The combustor according to claim 17, wherein the CMC dome is connected to the cowl structure within the inner clevis between the first inner clevis portion and the second inner clevis portion.

19. The combustor according to claim 18, further comprising an inner liner extending circumferentially about the combustor axial centerline and extending in the combustor longitudinal direction, the inner liner being connected to the cowl structure within the inner clevis, between the first inner clevis portion and the CMC dome.

* * * * *